US010344591B2

(12) United States Patent
McNealy et al.

(10) Patent No.: US 10,344,591 B2
(45) Date of Patent: Jul. 9, 2019

(54) HISTORY MATCHING MULTI-POROSITY SOLUTIONS

(71) Applicant: LANDMARK GRAPHICS CORPORATION, Houston, TX (US)

(72) Inventors: Timothy R. McNealy, Richmond, TX (US); Mohammadreza Ghasemi, College Station, TX (US)

(73) Assignee: Landmark Graphics Corporation, Houston, TX (US)

( * ) Notice: Subject to any disclaimer, the term of this patent is extended or adjusted under 35 U.S.C. 154(b) by 44 days.

(21) Appl. No.: 15/101,353

(22) PCT Filed: Jan. 2, 2014

(86) PCT No.: PCT/US2014/010036
§ 371 (c)(1),
(2) Date: Jun. 2, 2016

(87) PCT Pub. No.: WO2015/102632
PCT Pub. Date: Jul. 9, 2015

(65) Prior Publication Data

US 2016/0312607 A1 Oct. 27, 2016

(51) Int. Cl.
*E21B 49/00* (2006.01)
*E21B 41/00* (2006.01)

(52) U.S. Cl.
CPC ..... *E21B 49/00* (2013.01); *E21B 41/00* (2013.01); *E21B 41/0092* (2013.01)

(58) Field of Classification Search
CPC ..... E21B 49/00
USPC ..... 703/9–10; 702/6
See application file for complete search history.

(56) References Cited

U.S. PATENT DOCUMENTS 9,324,007 B2 * 4/2016 Wright ..... G06F 17/30516
2007/0162235 A1 7/2007 Zhan et al.
2008/0082469 A1 * 4/2008 Wilkinson ..... E21B 43/00 706/13
2010/0250216 A1 * 9/2010 Narr ..... G06F 17/5018 703/10
2011/0167025 A1 * 7/2011 Danai ..... G05B 17/02 706/12

(Continued)

OTHER PUBLICATIONS

EP Extended Search Report for EP Application No. 14877473.0 dated Sep. 6, 2017.

(Continued)

*Primary Examiner* — Eunhee Kim
(74) *Attorney, Agent, or Firm* — Locke Lord LLP

(57) ABSTRACT

A computer implemented method can include selecting a first flow rate model for a well, providing reservoir data to the first flow rate model, providing production history data to the first flow rate model, computing a solution to the first flow rate model and comparing the solution to production history data. A method can include implementing dual, triple or quad porosity models of a reservoir and history matching a model against actual well production data. A method can include comparing one or more models and determining whether a parameter has a unique solution. A system can include a computer readable medium having instructions stored thereon that, when executed by a processor, cause the processor to perform one or more methods.

16 Claims, 10 Drawing Sheets

(56) References Cited

U.S. PATENT DOCUMENTS

| | | | | |
|---|---|---|---|---|
| 2011/0307227 | A1* | 12/2011 | Poe | E21B 43/00 703/2 |
| 2013/0103615 | A1* | 4/2013 | Mun | G06Q 40/06 705/36 R |
| 2013/0124178 | A1 | 5/2013 | Bowen et al. | |
| 2013/0166216 | A1* | 6/2013 | Foot | E21B 43/00 702/12 |
| 2016/0178800 | A1* | 6/2016 | Ramsay | E21B 43/00 702/12 |

OTHER PUBLICATIONS

PCT Written Opinion for PCT Application No. PCT/US2014/10036 dated May 30, 2014.
PCT Search Report for PCT Application No. PCT/US2014/10036 dated May 30, 2014.
International Preliminary Report on Patentability for PCT Application No. PCT/US2014/010036 dated Jul. 5, 2016.
Examiner's Letters for Canadian Application No. 2932231 dated Feb. 16, 2017.

* cited by examiner $$AIC = n \ln(SSR/n) + 2K + 2K(K+1)/(n - K - 1)$$

# of data points (n) = 131

SSR : Sum of squared residual

| Model | # of Param (K) | SSR | AIC | Probability model is correct |
|---|---|---|---|---|
| Dual Porosity | 4 | 1.9446e5 | 964.98 | 9.9% |
| Triple Porosity | 6 | 1.8220e5 | 960.81 | 79.7% |
| Quad Porosity | 8 | 1.8161e5 | 964.88 | 10.4% |

FIG. 7

$$F = \frac{(SSR_1 - SSR_2)}{(SSR_2)} \times \frac{(n - p_2)}{(p_2 - p_1)}$$

# of data points (n) = 131
# of parameters ($p_i$)

| Comparison | F | P value |
|---|---|---|
| Dual vs Triple Porosity | 4.2 | 1.7% < 5% |
| Triple vs Quad Porosity | 0.18 | 83.8% > 5% |

FIG. 8

HISTORY MATCHING MULTI-POROSITY SOLUTIONS

FIELD OF INVENTION

The embodiments disclosed herein relate generally to methods and systems for determining reservoir properties and fracture properties in oil and gas wells.

BACKGROUND OF INVENTION

To maximize the production from an oil and/or gas well, it can be important to have an accurate computer model of the well. Fractured oil and gas reservoirs can be challenging to characterize and model, however. These challenges can arise, in part, because such reservoirs comprise the combination of interacting natural reservoir media and the fractures contained therein, each of which has different parameters, such as porosity and permeability. Multi porosity models, such as dual, triple and quad porosity models, have been developed to model naturally fractured reservoirs. Conventional models can typically rely on well pressure to determine reservoir properties. It can also be advantageous to model a reservoir based on actual history. History matching, however, can be a nonlinear problem and mathematically accurate models may have multiple solutions. Therefore, there is a need in the art for improved methods and systems for determining reservoir properties and fracture properties in wells, such as oil and gas wells.

BRIEF DESCRIPTION OF DRAWINGS

FIG. 7 is a graphical user interface illustrating an exemplary model comparison according to an embodiment of the present disclosure.

FIG. 8 is a graphical user interface illustrating another exemplary model comparison according to an embodiment of the present disclosure.

DETAILED DESCRIPTION OF DISCLOSED EMBODIMENTS

Figure 1:
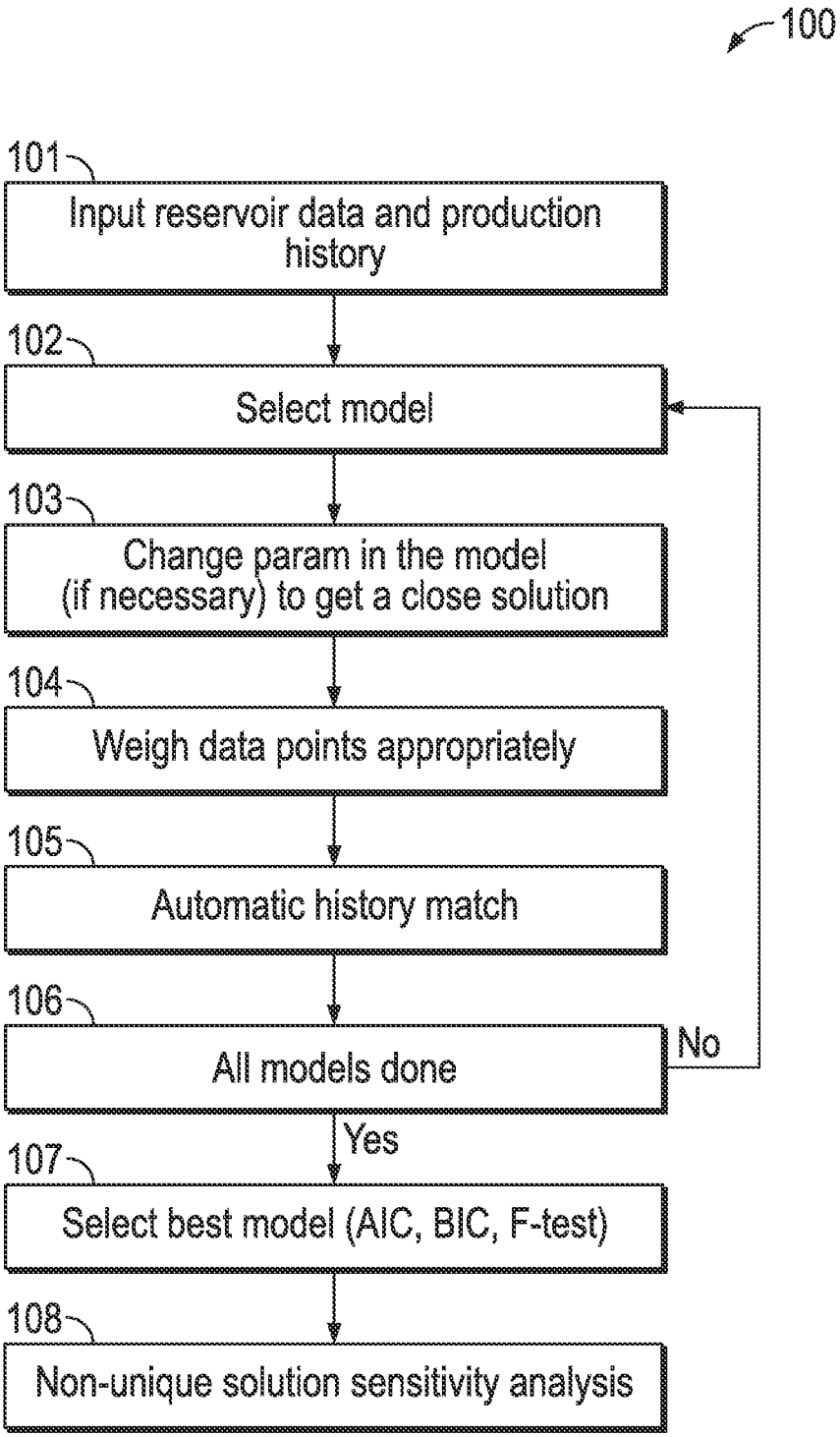
FIG. 1 is a flow diagram illustrating exemplary history matching multi-porosity modeling according to an embodiment of the present disclosure.

As an initial matter, it will be appreciated that the development of an actual, real commercial application incorporating aspects of the disclosed embodiments can and likely will require many implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would nevertheless be a routine undertaking for those of skill in this art having the benefits of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the present disclosure.

In one embodiment, there can be provided a method for determining reservoir properties and fracture properties in oil and gas wells based on dimensionless flow rate using computerized modeling. A computational model generally refers to a mathematical model that simulates the behavior of a system, such as the production from an oil and/or gas well, and allows a user to analyze the behavior of the system. In an embodiment, modeling using a dimensionless flow rate model of a hydrocarbon well can allow for determining reservoir and fracture properties from data sources where daily and/or monthly rates are available but the flowing pressure is not available. An example of such a data source would be the Texas Railroad Commission public cumulative production of oil, water and gas for all the wells in Texas. The data from this source can be used to determine a flow rate, but it typically does not provide the daily pressure data for the well, which can be a requirement in some computational models. In an embodiment using a dimensionless rate solution, this or other public data can be used for determining reservoir and fracture properties, even though the daily pressure data may be unavailable. This can allow a well engineer or other user to compare wells in the same geographical area (or others). While embodiments of the present disclosure can use pressure information if available, such information is not required because both rate and pressure exist in the same equation. In other words, to avoid having two partial derivatives in one equation (making the equation underdetermined), one can be made constant. This can be considered a significant difference between an analytical solution and a numerical solution. That is, in a numerical solution, both variables can change over time; but, during a single time step, one of them can be constant. Public production data and information about wells can be available from multiple sources, including, for example, private web services such as DrillingInfo.com, and one or more state government's public web service.

FIG. 1 is a flow diagram 100 illustrating exemplary history matching multi-porosity modeling according to an embodiment of the present disclosure. In block 101 reservoir data and production history can be provided to a computational model of a well. The production history is the actual data (or relevant portions of such data) measured at the well while it is in operation. The full range of information can include, for example, pressures, temperatures, volumes of oil, water, and gas produced by the well, and other information gathered by the well operator. Of course, the full range of available production information would be known to the well operator, but may not generally be available to the public. Although it can be desirable to have as much information about a well as possible, one or more embodiments of the present disclosure can allow accurate modeling and determination of reservoir properties and fracture properties using only the oil, gas and water flow rates of the well at hand, which can be any well. Depending on the location of the well, operators are sometimes required to make at least some well information public. In the U.S., for example, public data can typically include the volumes of oil, water and gas produced by a particular well, such as on a monthly or other periodic basis.

Providing historical data to a computational model can be performed in any manner that allows the computational model to access the data during operation. In one embodiment, which is but one of many, historical data can be entered manually, for example, through a suitable graphical user interface ("GUI") implemented on a computer containing or having access to the computational model. In another embodiment, historical data can be stored on a suitable storage medium, such as a hard disk, CD ROM, or flash drive that can be accessed or read by a processor, such as the processor executing the computational model. For example, historical data can be stored in the form of an Excel spreadsheet which can be accessed by the model. In still another embodiment, historical data can be stored on a computer system having a computer processor separate from the computer processor executing the computational model. For example, the historical data can be provided through a system configured in a client-server architecture, where the historical data can be stored on a server computer which can be accessed over a computer network by the computational model that can be running on a client computer processor. In yet another embodiment, a computational model can access historical data on a remote computer, such as through the Internet or through distributed computing or cloud computing architectures. As an example, for a project in a given geographic area (which can be any geographic area), a web service, in which the historical data can be stored on a computer server, can be accessed by a client computer over the Internet. A client computer can also be the modeling computer, or it can simply retrieve historical data for later access by a modeling computer. Accessing historical data can, but need not, include filtering inputs, such as to narrow the scope of wells from or regarding which to obtain the production data. Filtering options or criteria can include, for example, latitude and longitude, public land survey, operator name, well name, or other information, such as well American Petroleum Institute ("API") number or other identifying information. Once the scope of well data has been defined, the web service can transfer the data to a user defined location. Once the data is made available, the monthly cumulative volumes for oil, water and gas that were reported to a state, for example, can be converted to average monthly rates in view of their corresponding cumulative amounts of time. An Excel spreadsheet can be useful for this purpose. For instance, in at least one embodiment, an application or model can read or otherwise obtain data from an Excel spreadsheet which, for example, can be obtained from a comma-separated values ("CSV") file including the data, or another source. The multi-porosity computational model, discussed in embodiments below, can then consume this data and analyze it. Other information provided in block 101 can include reservoir data. Reservoir data can include data about well geometry and permeability, for example. In at least one embodiment, which is but one of many, a GUI can be provided for allowing entry of one or more parameters into a model engine.

Figure 2:
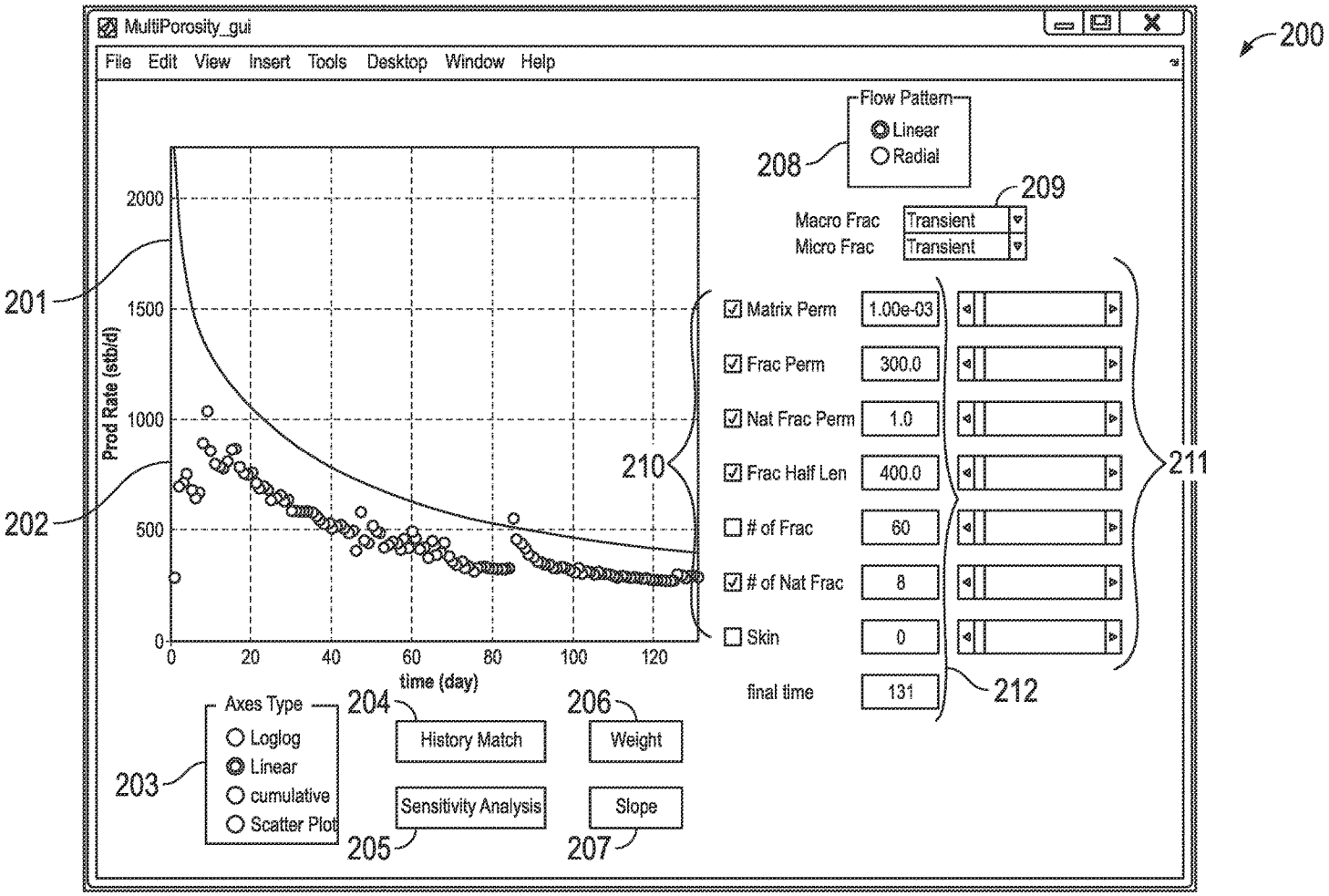
FIG. 2 is a graphical user interface providing exemplary history matching multi-porosity modeling data according to an embodiment of the present disclosure.

FIG. 2 is a graphical user interface providing exemplary history matching multi-porosity modeling data according to an embodiment of the present disclosure. On the right hand side of the screen in this embodiment, the GUI can allow entry of one or more parameters, such as, for example, matrix permeability $k_m$, man-made or secondary hydraulic fracture permeability $k_F$, natural fracture permeability $k_f$, fracture length (or, in some embodiments the half-length) $L_F$, number of secondary fractures, number of natural fractures, and skin. In the embodiment of FIG. 2, which is but one of many, the number of fractures can be the length of a drainage area of the model divided by $L_F$. The "skin" can be the pressure drop caused by a flow restriction in a near-wellbore region. Of course, it will be appreciated that this is only one embodiment, and that additional parameters can be added to (or omitted from) the GUI, for example, depending on the model used, the preferences of the system designer, or a particular application at hand. For example, if a computational model makes use of historical pressure information, then a similar entry window can be provided. The reservoir data can also be provided in one or more embodiments in like manners as those described with respect to the historical data, for example, through a spreadsheet or from suitable computer storage media located on the same computer executing the computational model or a remote computer accessible over a computer network or otherwise. Similarly, in other embodiments, the GUI shown in FIG. 2 can be provided on the same computer as the model or on a separate computer disposed in communication with the model computer.

In one or more embodiments of the present disclosure, it can be useful to hold some of the parameters constant rather than recalculate them. This can allow a user (e.g., a well engineer) to analyze how the output of the computational model can change in response to variations in one or more of its input parameters. Therefore, in the GUI 200 according to the embodiment depicted in FIG. 2, check boxes 210 can be provided to the left of each parameter. Checking the box can provide an input to the computational model, for example, so that the parameter can be iteratively calculated by the model when executed by the system computer. If the box is unchecked, however, then this can provide an input to the computational model so that the model can hold the corresponding parameter constant while only the parameters associated with the checked boxes can be iteratively calculated by the computational model. Such an embodiment can be useful in performing sensitivity analyses, for example. It will of course be understood that the above-mentioned inputs can be provided in other manners as well, including in the reverse of the order described (i.e., unchecking a box corresponds to iterative calculations while checked boxes correspond to constants).

The values of one or more parameters can be displayed, such as in a series of windows 211 in the GUI placed in relation to each parameter. Data entry boxes 212 can be provided, which can allow a user to enter values for each parameter. A user initially can provide a first set of inputs in data entry boxes 212 for the computational model to use as initial values for the parameters. These initial values can be estimated based on known or estimated values for similar wells in the area, for instance. They can also be chosen based on typical values or on the user's skill or experience. For example, typical values for porosity can be around 4-10 percent in some formations or locations, such as the so-called Eagle Ford shale, for example. Details of a well design can, but need not, provide or suggest a maximum limit for the total number of fractures, and can also provide or suggest a range for other fracture properties based on other analyses. In an embodiment, a computational model can iteratively re-calculate values for one or more parameters, for example, until the model can determine a solution that matches the historical data. The final values of one or more parameters, such as iteratively calculated by the computational model, can then be displayed in one or more windows 211.

On, for example, the left hand side of the GUI embodiment depicted in FIG. 2, which is but one of many, a display can show a comparison of a model result 201, indicated by the solid line, and production data 202, indicated by the series of data points. This can provide a visual indication of the computational model solution and how it performs against historical data. One or more other features can be included in a GUI (or plurality of GUIs), such as in the exemplary embodiment of FIG. 2. For example, a GUI can include controls or other inputs for one of more functions, such as for selecting the axes type 203, performing history matching 204, performing sensitivity analyses 205, weighing historic data 206, calculating a slope of the model 207, selecting the model flow pattern 208, separately or in combination with one or more other mechanisms, such as for selecting a transient or steady state analysis 209. One or more GUIs can be implemented as an algorithm on the same computer implementing the computational model. In one or more other embodiments, the GUI(s) can be implemented on a separate computer, for example, a computer or plurality of computers that can provide reservoir information to a model over a local network, over the Internet, or by way of another system for allowing or implementing data transfer or other communication between two or more computers.

A transient analysis, or unsteady state analysis, can assume that interaction between fractures and a matrix is changing during a given flow time interval. The pseudo steady state analysis can assume that interaction between fractures and a matrix is constant during a given flow time interval.

Figure 3A:
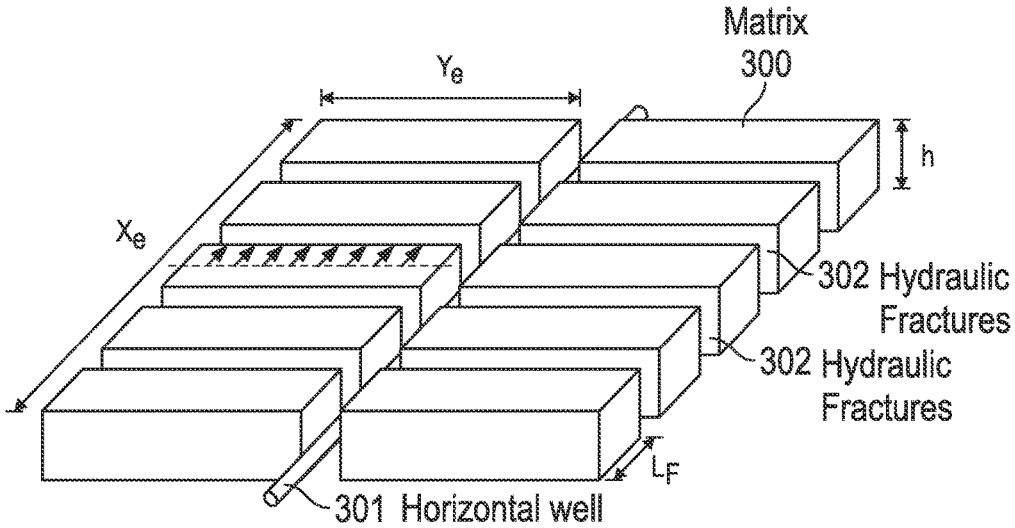
FIG. 3A is a schematic perspective view of an exemplary dual porosity model according to an embodiment of the present disclosure.
Figure 3B:
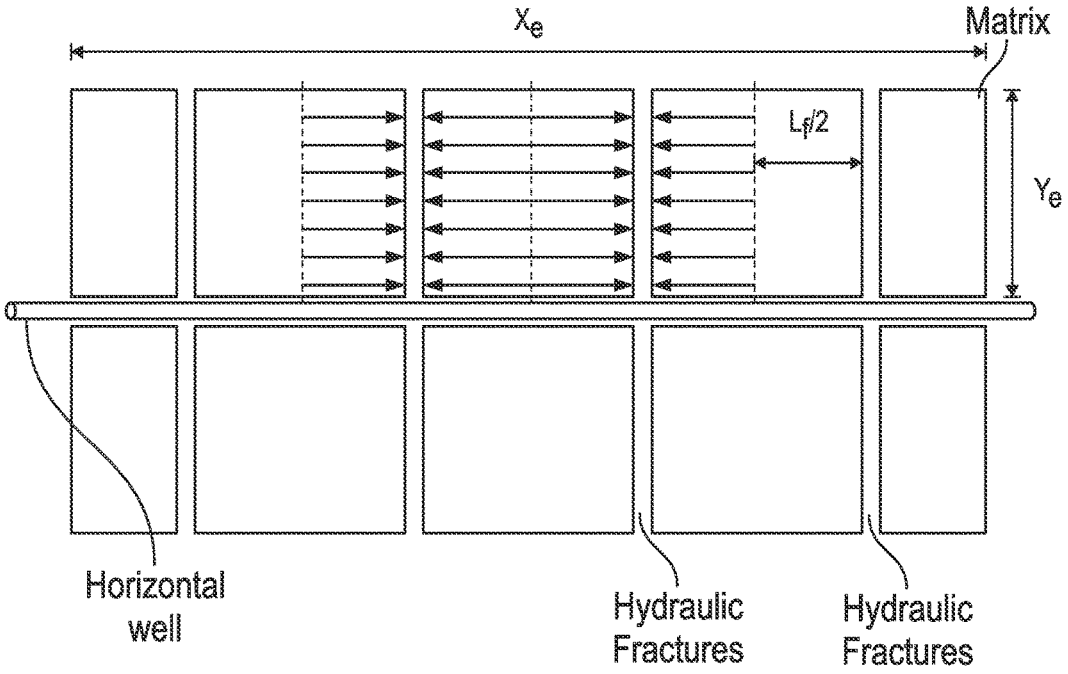
FIG. 3B is a plan view of the embodiment depicted in FIG. 3A.
Figure 4A:
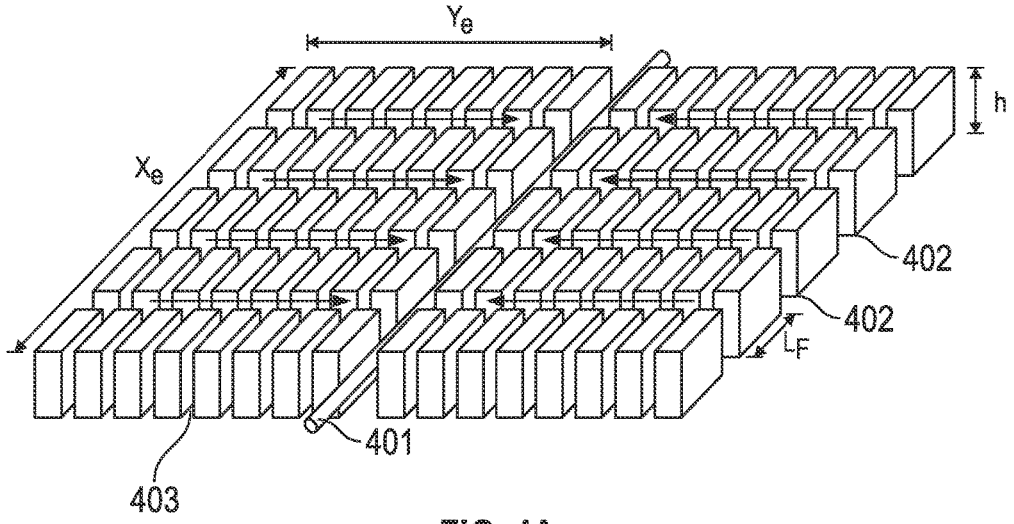
FIG. 4A is a schematic perspective view of an exemplary triple porosity model according to an embodiment of the present disclosure.
Figure 4B:
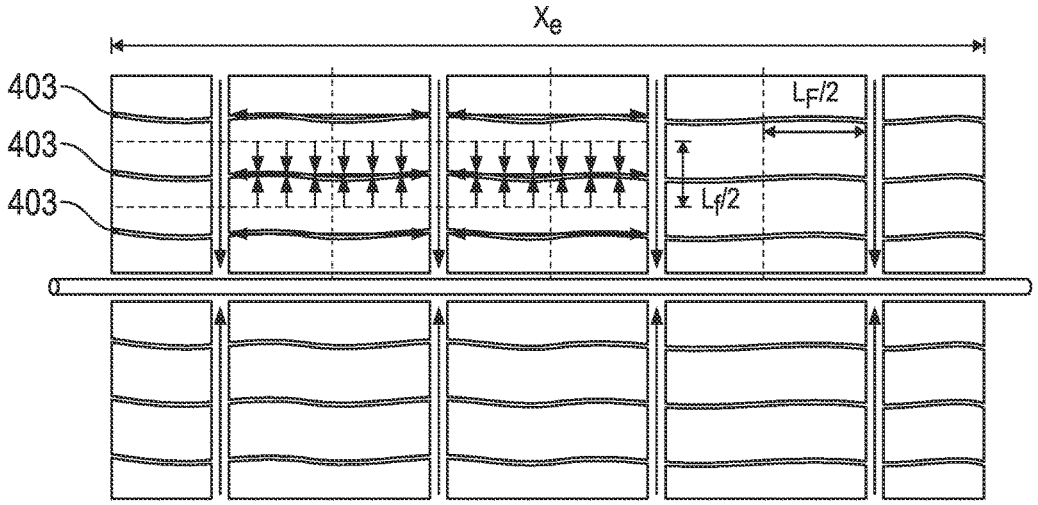
FIG. 4B is a plan view of the embodiment depicted in FIG. 4A.

The initial values for the parameters supplied by a user through a GUI (e.g., the GUI of FIG. 2) can be provided to a computational model of a well. Exemplary embodiments of a computational model using a dimensionless flow rate will be described with respect to FIGS. 3A-4B. FIGS. 3A-4B provide schematic depictions of geometry that can be used according to one or more embodiments of the present disclosure. FIG. 3A is a schematic perspective view of an exemplary dual porosity model according to an embodiment of the present disclosure. FIG. 3B is a plan view of the embodiment depicted in FIG. 3A. FIG. 4A is a schematic perspective view of an exemplary triple porosity model according to an embodiment of the present disclosure. FIG. 4B is a plan view of the embodiment depicted in FIG. 4A. FIGS. 3A-4B will be described in conjunction with one another. A well drainage area can be modeled as a rectangular block of subsurface matrix having a length x, width y, and a height h. The horizontal wellbore 301 can run through the matrix (e.g., through the middle) along length x. Extending outwardly along both sides of a horizontal wellbore 301 can be the main hydraulic fractures 302. The hydraulic fractures 302 can serve to transport hydrocarbons from a formation matrix to a wellbore 301. The fracture length $L_F$ can be modeled as a length between the main hydraulic fractures in a formation matrix, as shown in the figures. One-half of the fracture length, or $L_F/2$, can be the distance from the formation fracture to a center of the relevant section of matrix 300. This can be seen in the plan view of the dual porosity geometry model shown in FIG. 3B. In the dual porosity model, the matrix can be assigned a matrix or reservoir permeability $k_m$ and each main, or hydraulic, fracture 302 can be assigned a permeability $k_F$.

With continuing reference to the Figures, and specific reference to FIGS. 4A-4B, a triple porosity model geometry can be similar to the dual porosity model except that in addition to the main hydraulic fractures 402, the triple porosity model can include additional fractures 403 running along the length x of a formation matrix 400 to simulate natural fractures. Fractures 403 in the triple porosity model, sometimes referred to as natural fractures, can be assigned a permeability $k_f$. An exemplary geometric arrangement of the fractures is depicted in the plan view of the geometry of the triple porosity model shown in FIG. 4B. The geometry of the multi-porosity models can be adapted to include any number of fractures required by or appropriate for a particular application. For example, a quad porosity model can be constructed by extending the model to an additional set of fractures that could be modeled, e.g., as running along both the length x and width y of a formation matrix, such as at the midpoint of the matrix height h, or at another location along height h. Such additional fractures can be considered to be disposed in one or more planes, such as a plane that can be described as the "z" plane. These fractures can also be assigned one or more permeability designations. For convenience, in a multi-porosity model, it can be useful to adopt the designation $k_i$, where "i" represents an index of n number of porosities or other variables associated with "i" number of fractures. This notation will be adopted in describing one or more embodiments below, which notation those of skill in the art will appreciate reflects the form of a multi-porosity model.

In at least one embodiment of Applicants' present disclosure, a linear flow of fluid(s) through one or more of embodiments of the models described above can be represented by the following dimensionless linear flow, which, in Laplace space, can be determined by:

$$\frac{1}{q(s)} = \frac{2\pi s}{\sqrt{sf(s)}}\mathrm{COTH}\left(-2\sqrt{sf(s)}\,y_{De}\right)$$

where q(s) is a dimensionless flow rate in Laplace space (alternatively, q(s) can be represented as $q_{DL}(s)$ or $\overline{q_{DL}}$ wherein "DL" stands for dimensionless and the bar over $q_{DL}$ indicates Laplace space), f(s) is the fracture function, and $y_{De}$ is the dimensionless reservoir half-width (rectangular geometry). The fracture function can be given in such an embodiment as:

$$f_i(S) = \frac{3}{\lambda i - 1}(\omega_i + F_i)$$

where λ is a dimensionless interporosity parameter and ω is the dimensionless storativity ratio. These parameters, in turn, can be represented in this embodiment as:

$$\omega_i = \frac{\phi_i V_i}{\phi_t V_t}$$

$$\lambda i = \frac{12}{L_F}\frac{k_i}{k_F}A_{cw}$$

where $\omega_i$ is the indexed, dimensionless storativity ratio, $A_{cw}$ is the cross-sectional area to flow (defined below) and $\lambda_i$ is the indexed, dimensionless interporosity flow. The initial conditions can be given as:

$A_{cw}$=2 h $x_e$, where h is the reservoir thickness and $x_e$ is the lateral length, $\emptyset_i$=Porosity fraction of the respective media and $\Sigma_i^N$=1 $\omega_i$=1, $\lambda_0$=3, $F_N$=O, where N is the number of porosity, i.e., dual porosity N=2, triple porosity N=3, quad porosity N=4, etc.

In a model according to this embodiment, the geometry of the well can be described as:

$$F_i = \frac{\lambda_i}{3s}\sqrt{sf_{i+1}(s)}\,\mathrm{TANH}\left(\sqrt{sf_{i+1}(s)}\right)$$

for a pseudo steady state model and $$F_i = \frac{\lambda_i f_{i+1}(s)}{3 + sf_{i+1}(s)}$$

for a transient flow (unsteady state) model.

Returning now to FIG. 1, in block 102, a first model can be selected, such as, for example, a dimensionless flow triple porosity model as described above. In such an embodiment, which is but one of many, the number of fractures n in the model can be two. This model can be used to evaluate well performance according to one or more embodiments of the present disclosure. It will be appreciated that in at least one embodiment of the present disclosure, different models can be tested against each other, for example, to determine which model(s) provides the most accurate results for a particular well, which can be any well.

One or more computational models according to Applicants' disclosure can be computer implemented. The computational models can be created in any suitable software programing language, such as C, C++, Java, FORTRAN, or one or more other languages, such as C#, F#, J#, Javascript, Python, or another language, separately or in combination, in whole or in part. In at least one embodiment, for example, a computational model can be implemented in MATLAB®, which can be described as a numerical computing environment or programming language and which will be familiar to one or more of those with experience in the relevant art.

Figure 5:
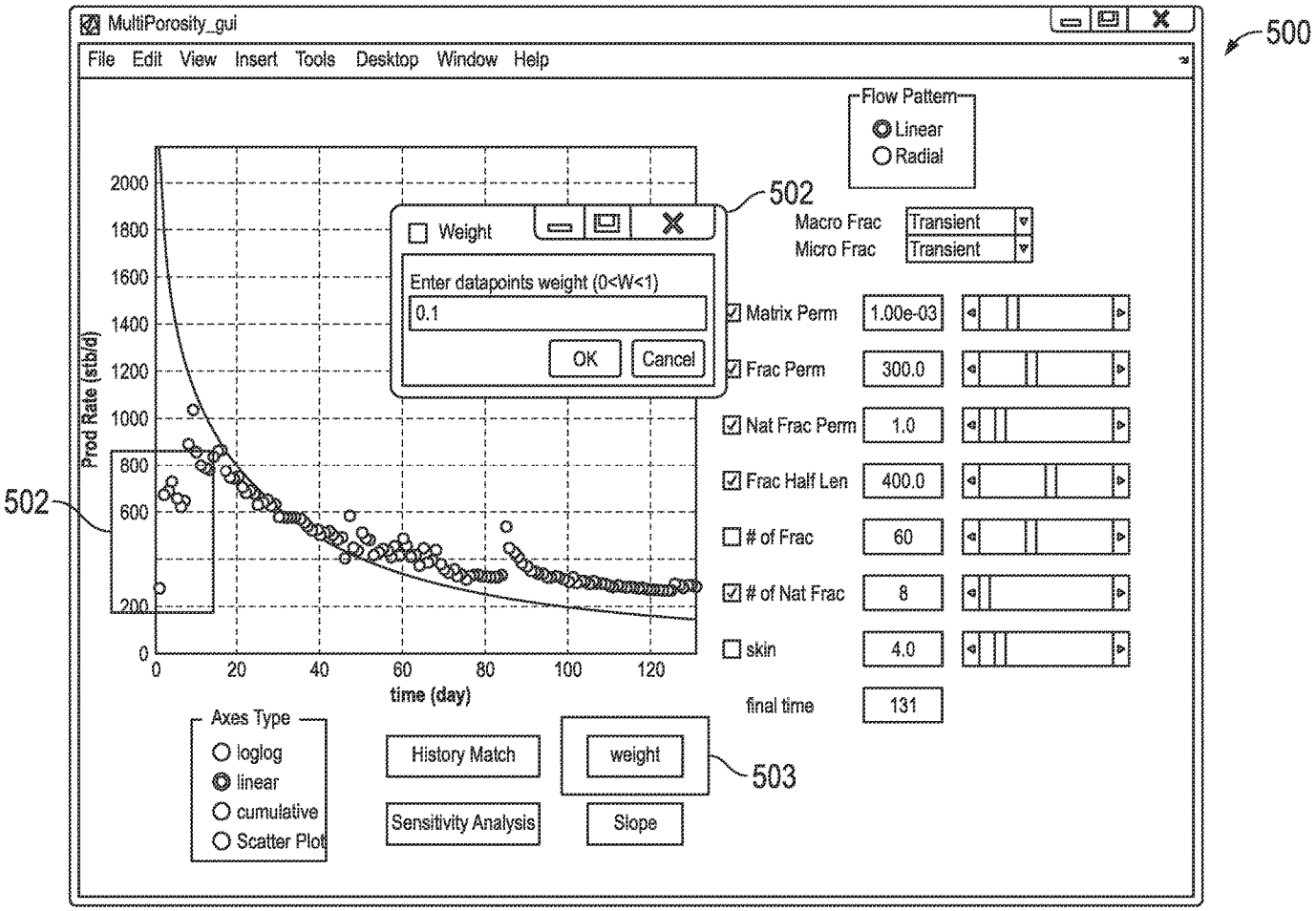
FIG. 5 is a graphical user interface providing exemplary history matching multi-porosity modeling data according to an embodiment of the present disclosure.
Figure 6:
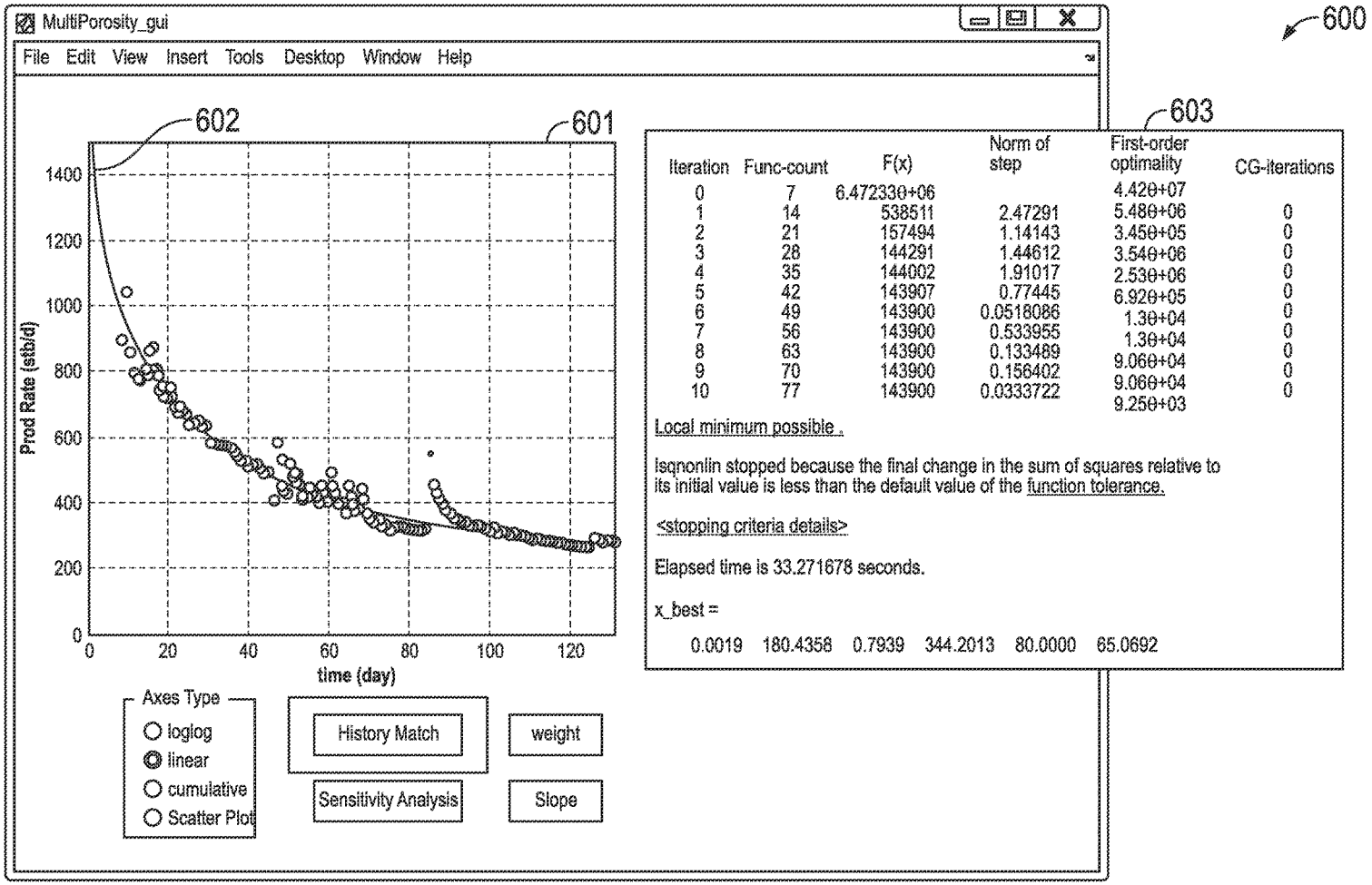
FIG. 6 is another graphical user interface providing exemplary history matching multi-porosity modeling data according to an embodiment of the present disclosure.

In block 103, one or more parameters can be changed, for example, if necessary or desired to obtain a close, closer or other different solution. In one embodiment, a chosen model can be used to determine a flow rate. The model can be initially run using a set of parameters with initial values, which can be input to the model through one or more entry boxes 212 in a GUI (see, e.g., FIG. 2). The initial values can be chosen by the user based on experience, or preferably, with known information from similar wells in the area (or another source appropriate for an application at hand). The initial parameters can include estimates of the permeabilities $k_f$ and $k_F$, the fracture length $L_F$ and/or the cross-sectional area to flow $A_{cw}$. From these values, λ and ω can be calculated, such as according to the equations described above. In block 104, the user, if desired, can weigh data points. Normally, relatively early production data can tend to be noisy and inaccurate. Therefore, relatively recent production information can be more helpful or accurate when forecasting the future production of a well. Block 104 can allow a user to assign a weight to one or more data points, which can, for example, at least help compensate for data that may be less reliable or important than other data (e.g., early data versus more recent data, etc.). FIG. 5 is a graphical user interface providing exemplary history matching multi-porosity modeling data according to an embodiment of the present disclosure. FIG. 6 is another graphical user interface providing exemplary history matching multi-porosity modeling data according to an embodiment of the present disclosure. In the exemplary GUI 500 embodiment shown in FIG. 5, a group of historical data points can be selected in a selection box 501, which can be sized by moving a mouse or other input device to select only a group of points that appear to be inconsistent with the trend of other data points from a well. These points can reflect noisy or poor measurements, for instance, and using a pop-up box 502, for example, a well engineer can reduce the weight given to such points during use by a model. A model can be instructed to weigh one or more points according to its assigned weight, such as by way of a weight button 503 being activated (or deactivated, if desired).

After a model is run (or otherwise) using initial parameters and any weighting of data, if applicable, an automatic history match can performed in block 105. Model flow rates can be computed and compared to the flow rates determined from historical data and an error rate can be calculated. History matching can be performed by techniques familiar to those skilled in the art, such as by nonlinear regression. In one or more embodiments of the present disclosure, an optimization function in MATLAB can be used to iteratively find a solution to the dimensionless rate model in Laplace space as described above. Other algorithms for performing nonlinear regression also can be used, as a matter of preference. Suitable nonlinear algorithms are known to those of skill in the art and can be implemented in, for example, C, C++, MATLAB, FORTRAN, or any other suitable computer language. In at least one embodiment, the iterations that can required to determine solutions for a computational model to determine the value of the parameters can be performed according to MATLAB's nonlinear regression function, "lsqnonlin."

At the end of a regression, a history matched solution determined in block 105 can be displayed to a user for analysis. For example, as shown on the left hand side of the exemplary GUI 600 of FIG. 6, an embodiment can depict a display of a history matched model. A historical flow rate can be shown, such as by individual data points in a chart 601. A dimensionless model flow rate can be depicted in a curve 602. Parameters for $k_f$ and $k_F$ calculated by a model can be shown in a pop-up window 603. An output of the lsqnonlin nonlinear regression algorithm can be shown in a window as well, such as window 603. The actual values for the permeabilities, fracture lengths, and other parameters can be determined by the model through an iterative history matching process according to embodiments of the present disclosure. These values can then be used by a user to evaluate and predict the future production of a well.

With continuing reference to the Figures, and specific reference to FIG. 1, in block 106, a determination can be made regarding whether additional models are to be evaluated. This can allow a well engineer to determine whether to adjust the parameters and re-run a previous computational model or whether to select a different model altogether. At block 106, results from a history match performed in block 105 can be compared against an acceptable error, which can be based, for example, on a difference between the actual and modeled production rates. The cumulative production of fluids, such as oil, gas, oil and water, oil and gas, or oil and water and gas, for both an actual and a computational model can be compared with the expectation that the error will be less than an amount satisfactory to the requirements set by a user, which can be any percentage of error.

In at least one embodiment, error can be calculated as a root-mean-squared rate according to the formula Error(x)=((Qmodel(x)−Qactual(x))*weight(x)), where x is the value of a parameter, Qmodel(x) is the value of the parameter iteratively calculated by a computational model, Qactual(x) is the actual value of the parameter as measured in, or derived from, the historical data, and weight(x) is the influence of a data point on the error which affects the history match. An initial or default weight value for all data points can be 1 until changed by a user, although this need not be the case and each initial weight can be any value, whether the same as or different from one or more other weight values. A user can set a desired range of acceptable error as a matter of design preference.

In at least one embodiment, if a model flow rate falls outside a range of acceptable error, then the work flow can proceed back to block 102. If the well engineer or other user elects to re-run a then-current model, then flow can proceed to block 103 and then block 104 where the well engineer can adjust and/or re-weigh one or more parameters. A computational model can then compute the history match in block 105. This process can be repeated until a model flow rate matches a historical flow rate to within an acceptable error, or until a number of allowable iterations has been reached. The model selection can be defined by a user, for example, in MATLAB or other source code. At block 106, a well engineer can choose to compare one or more models, such as dual, triple, and/or quad porosity models, against one another to see which model(s) provide the best results for a subject well. Flow can proceed back to block 102, where a different model can be chosen by a suitable entry or input to a computer, for example, a selection box or a command window on one or more GUI screens. The actions described in blocks 103-105 can be repeated for one or more models. In block 106, after all models which a well engineer has selected for analysis have been determined through one or more of the actions described with respect to blocks 103-105, flow can proceed to block 107 for selecting a best model.

Referring still to FIG. 1, in block 107, a best model can be selected, such as by a user, system or combination thereof. One or more models can be compared using one or more statistical tools to select a model, for example, a model that most accurately matches the actual historical production data. Models can be compared using the Akaike Information Criteria, or "AIC" value. The AIC compares a model's residual sum of squares to the model's complexity (number of variables). A model with the lowest AIC value can have the highest relative probability of minimizing information loss and the lowest probability of overfitting or having too many parameters.

In such an embodiment, the AIC parameter can be calculated using the following formula:

$$AIC = n\ln\left(\frac{SSR}{n}\right) + 2K + \frac{2K(K+1)}{n-K-1}$$

where n is the number of data points, SSR is the sum of squared residual, and K is the number of parameters used in the model (i.e., Km, Kf, KF, etc.).

FIG. 7 is a graphical user interface illustrating an exemplary model comparison according to an embodiment of the present disclosure. FIG. 7 shows the results of an exemplary AIC calculation. Here, dual, triple, and quad porosity models were compared. It is apparent that in this example embodiment, which is but one of many, the best model for this particular well would be the triple-porosity model because the probability of that model being correct was found to be 79.7% (i.e., a higher probability than those for the remaining models).

In another embodiment, the models can be compared using an F-test, which can be calculated according to the following formula:

$$F = \frac{SSR1 - SSR2}{SSR2} \times \frac{n - p2}{p2 - p1}$$

where n is the number of data points, SSR1 is the sum of squared residual for the first model, SSR2 is the sum of squared residual for the second model, p1 is the number of parameters in the first model, and p2 is the number of parameters in the second model. FIG. 8 is a graphical user interface illustrating another exemplary model comparison according to an embodiment of the present disclosure. The results of an exemplary F-test, i.e., values of F from the equation above using an exemplary set of parameters for illustrative purposes, are shown in FIG. 8. Again, in this example embodiment, which is but one of many, for the particular data related to the exemplary well analyzed, the triple porosity is shown to be superior to either the dual or quad porosity models. It should be noted that the F-Test is a comparison between two nested models to determine if the model with more parameters yields a significantly lower error. Models with more parameters can result in a better fit to the actual data, but can add additional complexity to the task of resolving a unique solution. The P-value is a probability measure of the sum of squares over the degrees of freedom to determine the significance of one model compared to the other.

Figure 9A:
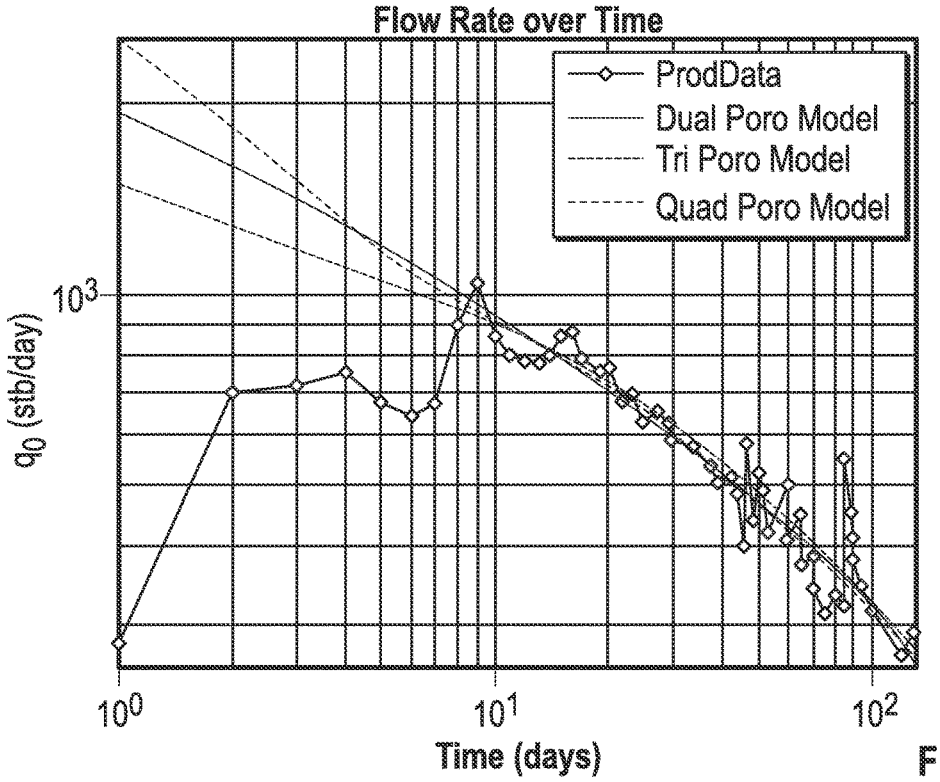
FIG. 9A is a graphical user interface illustrating an exemplary comparison of models with production data according to an embodiment of the present disclosure.
Figure 9B:
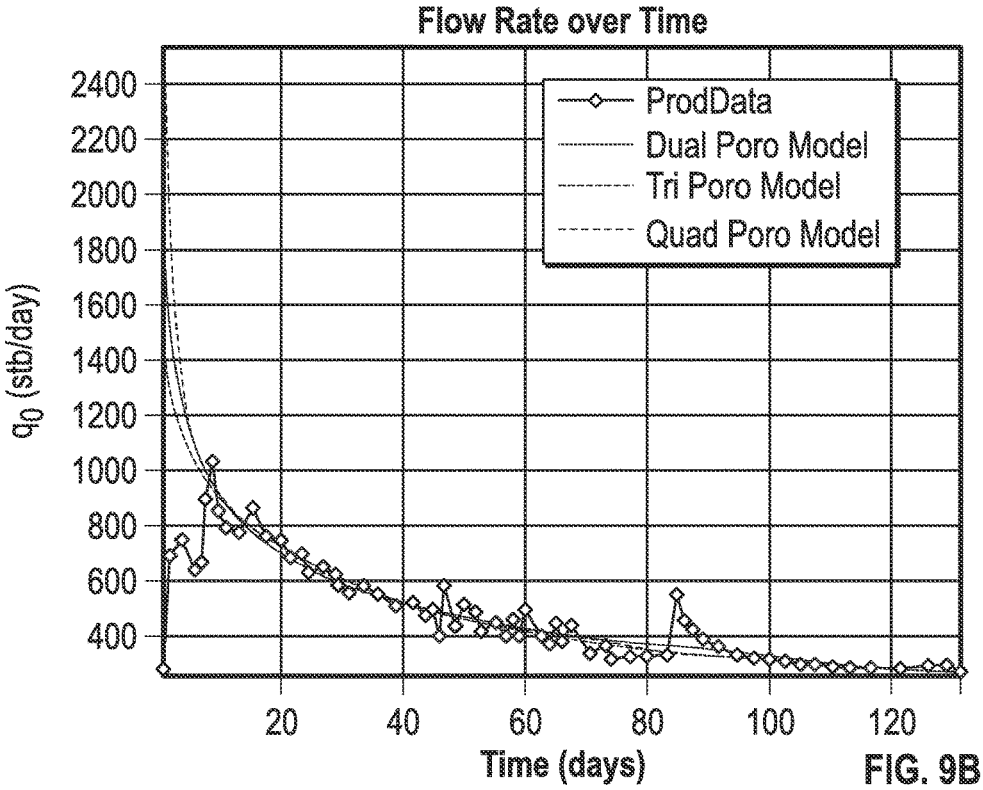
FIG. 9B is a graphical user interface illustrating another exemplary comparison of models with production data according to an embodiment of the present disclosure.

Those of skill in the art having the benefits of the present disclosure will appreciate that other methods of comparing models can be used. For example, in yet another embodiment of the present disclosure, two or more models can be compared using Baysian Information Criteria ("BIC"). In one or more embodiments, a well engineer can visually display one or more model comparisons, in addition, or as an alternative, to one or more statistical comparisons. FIG. 9A is a graphical user interface illustrating an exemplary comparison of models with production data according to an embodiment of the present disclosure. FIG. 9B is a graphical user interface illustrating another exemplary comparison of models with production data according to an embodiment of the present disclosure. FIGS. 9A, 9B show embodiments of the present disclosure depicting a comparison of three exemplary models (e.g., those described herein for illustrative purposes) with the corresponding historical production data by way of a graphical display. Differences in the models can be observed, for example, in the slope of the data as well as the accuracy of the history match. Visually inspecting the output of the models can be helpful in validating the overall accuracy of the output as each model can use the same input that might have been weighted for various reasons. Additionally the use of a LogLog plot can help visualize the slopes of actual and modeled data and can help determine when in time each flow regime occurred.

In block 108, a non-unique solution sensitivity analysis can be performed. The non-linear regression used in history matching in block 105 can yield non-unique solutions. Non-unique solutions can be problematic because different parameter combinations can result in different solutions that satisfactorily match the historical data, but yield different values for the iteratively computed parameters in a model, such as matrix permeability, main hydraulic fracture permeability, porosity and so forth. Because different values for these parameters can result in different predictions for an actual well production, it can be helpful to analyze results to find unique solutions or clear trends between the parameters that can allow at least some confidence that the computed parameters match the actual formation properties. At block 108, a non-unique solution that can be found in a well production analysis can be the inverse relationship between a hydraulic fracture's length and permeability. This relationship can be observed, for example, in a dimensionless fracture conductivity equation and a skin factor equation for a hydraulic fracture. In at least one embodiment of the present disclosure, the parameters for a particular model can be varied within a range (which can be any range) and the resulting distributions can be used to determine the sensitivity of the model.

Figure 10:
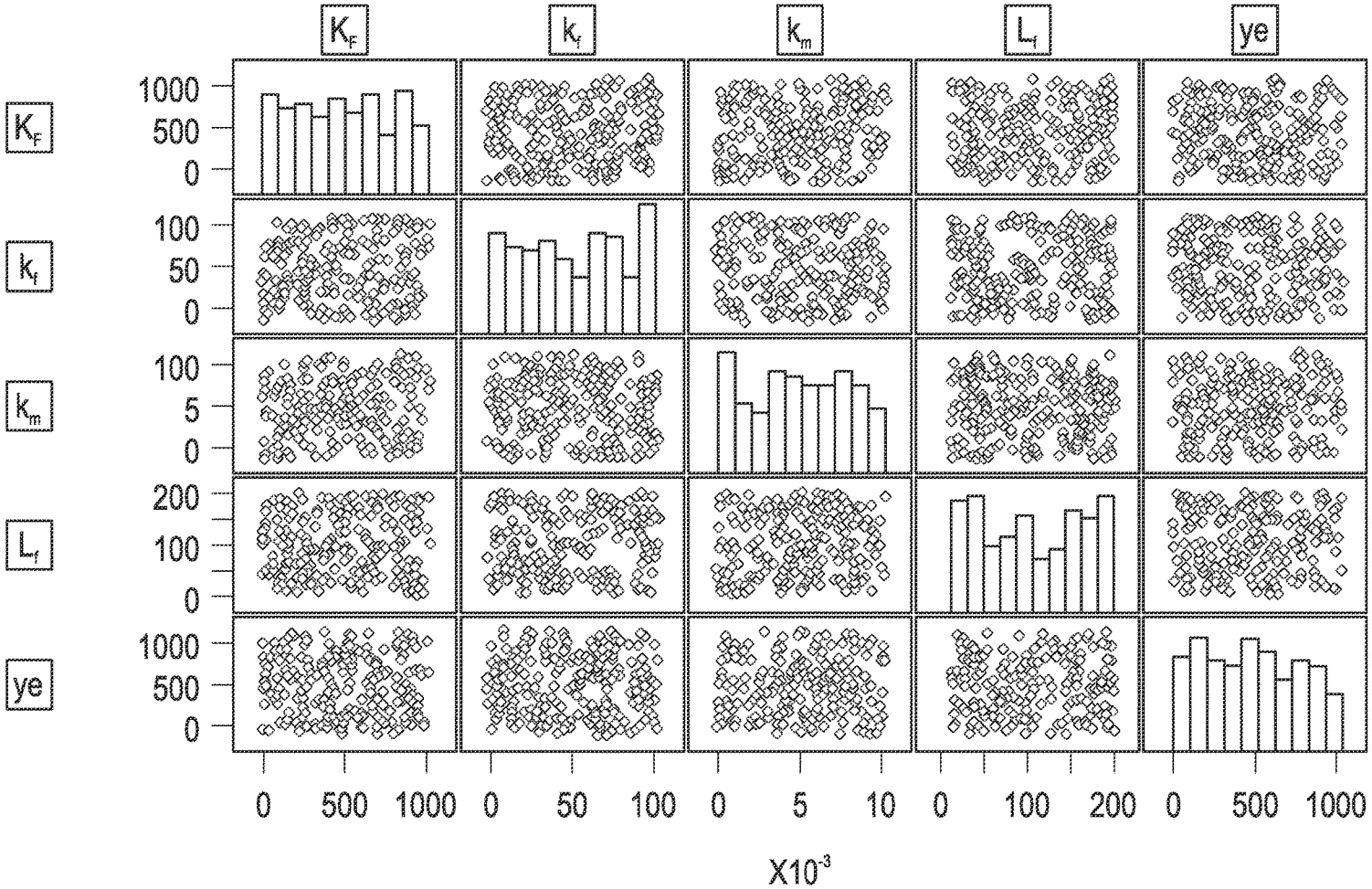
FIG. 10 is a graphical user interface illustrating an exemplary statistical distribution according to an embodiment of the present disclosure.

FIG. 10 is a graphical user interface illustrating an exemplary statistical distribution according to an embodiment of the present disclosure. FIG. 10 shows an initial parameter distribution prepared according to an embodiment of the present disclosure for an exemplary set of dual, triple, and quad porosity models using a dimensionless flow rate determined according to a computational model as described herein. Uniform random sampling of one or more initial parameters can be used to determine aspects of the model. One or more parameters can be varied within a range, such as a range sufficient to include any values that are plausible based on, for example, area knowledge and experience. A set of initial values can be chosen based on any available information that a user may have regarding the corresponding variable. For example, a model can benefit from (i.e., by becoming more accurate or more likely to be accurate) a set of initial values for a variable chosen from as narrow of a range as possible for that value. Also, even this set can be chosen from a different distribution, such as Gaussian, Poisson, etc., if any a priori information is available about the corresponding variable. This inverse modeling problem can be non-linear and it can generate multiple local minima solutions. Covering the range of all possible solutions as initial parameters can allow a sensitivity analysis to identify most or all of the local minima, which can quantify an extent of any non-unique solutions. Without using a uniform random sampling on the initial parameters it can be possible that some local minima will never be detected. FIG. 10 is an exemplary Bi-Plot or Matrix Plot of 2D Plots showing relationships of each variable to all other variables in the embodiment (which is but one of many). Each row header in this example identifies the variable for the Y-Axis along the corresponding row; similarly, each column header identifies the variable for the X-Axis along the corresponding column. The plots along the diagonal show an initial histogram (e.g., a graph of a frequency distribution in which rectangles with bases on the horizontal axis are given widths equal to class intervals and heights equal to corresponding frequencies) for the variable corresponding to the respective row-column intersections. As shown in FIG. 10 for illustrative purposes, the histograms (and the intervals or interlogs in the remaining graphs) can illustrate whether the initial parameters for a particular application were (or were not) selected with uniform probability. In the exemplary embodiment of FIG. 10, which is but one of many, five variables were used, namely, $k_F$ (main (or hydraulic) fracture permeability), $k_f$ (natural fracture permeability), km (reservoir (or matrix) permeability), $L_f$ (distance between natural fractures) and ye (main (or hydraulic) fracture half-length), but other variables and numbers of variables (which can be any number) can be used in accordance with a particular application. In this example, two hundred initial values were selected for each variable out of a range of possible values for that variable, although this need not be the case and, alternatively, any number of initial values can be used, such as, 1, 5, 20, 50, 100, 300, 400 . . . n values, such as up to 5000 or more values, including any number there between (including whole numbers and any fractional portions of any of them). In at least one embodiment, it can be advantageous to use between about 100 and about 300 values for each variable, although this need not be the case. The data can be displayed in a log-normal distribution, but need not be, and can alternatively be illustrated or otherwise represented in one or more other distributions, such as a Gaussian or other elliptical distribution, a circular distribution or, as another example, a Pareto distribution. In at least one embodiment, a model according to the disclosure can be adapted to analyze a set of initial values and to determine for one or more variables a best match to actual production data. In other words, a model can at least partially narrow a list of available choices for the value of one or more variables within a range of possibilities. In this manner, a model can identify one or more values that may be more probable than one or more other values to be accurate for a particular application, which can, but need not, include identifying a trend. Such information can be displayed to a user, for example, by way of a GUI or other interface, such as the one shown in FIG. 11.

Figure 11:
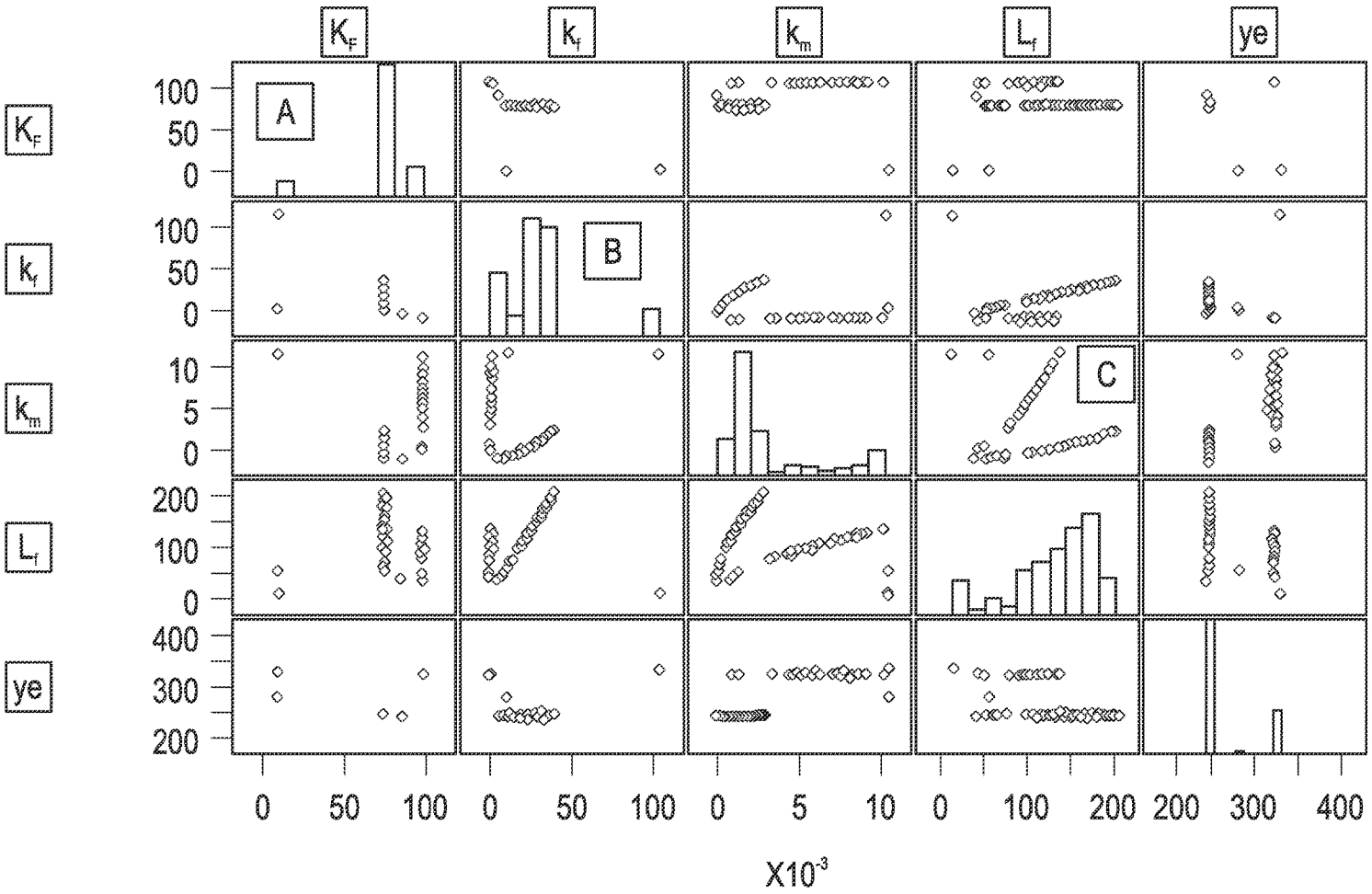
FIG. 11 is a graphical user interface illustrating another exemplary statistical distribution according to an embodiment of the present disclosure.

FIG. 11 is a graphical user interface illustrating another exemplary statistical distribution according to an embodiment of the present disclosure. FIG. 11 shows a matrix plot for the exemplary data and parameters discussed above after a sensitivity analysis or history match. A matrix plot can include one or more plots (e.g., 2D images) or subplots for identifying one or more relatively probable values for one or more parameters. Along a diagonal of a matrix plot can be a subplot for each parameter, such as a histogram which can indicate the frequency of one or more values for a parameter.

The histogram for each parameter and/or the remaining individual subplots can demonstrate the local minima and the probabilities for a unique solution along with the relationship each parameter has to other parameters. Because a triple porosity model is underdetermined, the solution to the inverse problem is not unique. This problem can be avoided, for example, by holding at least one parameter constant. With continuing reference to FIG. 11, subplot A, for example, can indicate to a user that, in the example embodiment described herein for purposes of explanation and illustration, a most likely value for $K_F$ can be approximately 75 (or 0.075 using the exemplary multiple indicated; the multiplier hereinafter will be ignored for simplicity). As another example, subplot B can indicate to a user that, in the example embodiment described herein, a most likely value for $K_f$ can be within the range of 0-50. As yet another example, subplot C can indicate to a user that, in the example embodiment described herein, more information can be needed to determine a unique solution for a value of $L_f$. Further, the two curves of subplot C can indicate to a user that, in the example embodiment described herein, there can likely be two solutions for a value of $L_f$; under such circumstances, a user can determine which one is best for a particular application based on, for example, other information available to the user about the project at hand, experience or knowledge in the field, etc. For instance, one or more of a plurality of unique solutions may be inapplicable in light of certain circumstances.

A system architecture in or with which embodiments of the present disclosure can be implemented can include any computer system or architecture capable of processing or running one or more embodiments of the models disclosed herein. For example, one or more of the models disclosed herein can compute on an x86, x64 or ARM based processor running on one of many available operating systems (e.g., MAC, WINDOWS, ANDROID, LINUX, etc.), and can do so regardless of whether a computer system available to a user includes a graphics processor for visualization. For example, in the event available computer hardware does not include a graphics processor, a command console (e.g., MSDOS, LINUX, etc.) can be used to setup, run and/or export/view one or more model outputs, such as by way of texts, characters, strings or other applicable designations.

A computer implemented method can include selecting a first flow rate model for a well, the first flow rate model having at least one input parameter, providing data to the first flow rate model, such as reservoir data and production history data, computing one or more solutions to the first flow rate model, which can include using an initial value for a input parameter, comparing a solution to production history data, adjusting an input parameter, computing a solution to the first flow rate model using one or more adjusted input parameters, selecting a second flow rate model for a well, the second flow rate model having at least one input parameter, providing reservoir data to the second flow rate model, providing production history data to the second flow rate model, computing one or more solutions to the second flow rate model, which can including using one or more input parameters, comparing a solution to production history data, adjusting an input parameter, computing a solution to the second flow rate model using one or more adjusted input parameters, comparing a solution from the first model with a solution from the second model, and determining which model most accurately tracks the production history data.

A first flow rate model can include a multi-porosity dimensionless flow rate model, which can include a dimensionless flow rate model of the form $$\frac{1}{q(s)} = \frac{2\pi s}{\sqrt{sf(s)}}\mathrm{COTH}\left(-2\sqrt{sf(s)}\,y_{De}\right).$$

An input parameter can represent reservoir data and can include one or more values representing one or more of formation matrix permeability, hydraulic fracture permeability, fracture length, and a combination thereof. A method can include determining whether a model solution that most accurately tracks the production history is unique, which can include varying an input parameter over a range of values and determining a plurality of model solutions. Production history data can include data representing a volume of oil, water, and/or gas produced by a well over a time period. A method can include iteratively adjusting an input parameter and computing a solution to a flow rate model until a solution is within an error criteria, and can include statistically comparing a solution from a first model with a solution from a second model, which can include determining a value based on one or more of the Akaike information criteria, the F-Value, the Baysian information criteria, and a combination thereof.

A computer readable medium can have instructions stored thereon that, when executed by a processor, can cause the processor to perform a method that can include selecting a first flow rate model for a well, the first flow rate model having at least one input parameter, providing data to the first flow rate model, such as reservoir data and production history data, computing one or more solutions to the first flow rate model, which can include using an initial value for a input parameter, comparing a solution to production history data, adjusting an input parameter, computing a solution to the first flow rate model using one or more adjusted input parameters, selecting a second flow rate model for a well, the second flow rate model having at least one input parameter, providing reservoir data to the second flow rate model, providing production history data to the second flow rate model, computing one or more solutions to the second flow rate model, which can including using one or more input parameters, comparing a solution to production history data, adjusting an input parameter, computing a solution to the second flow rate model using one or more adjusted input parameters, comparing a solution from the first model with a solution from the second model, and determining which model most accurately tracks the production history data.

In a computer readable medium can have instructions stored thereon, a first flow rate model can include a multi-porosity dimensionless flow rate model, which can include a dimensionless flow rate model of the form $$\frac{1}{q(s)} = \frac{2\pi s}{\sqrt{sf(s)}}\mathrm{COTH}\left(-2\sqrt{sf(s)}\,y_{De}\right).$$

An input parameter can represent reservoir data and can include one or more values representing one or more of formation matrix permeability, hydraulic fracture permeability, fracture length, and a combination thereof. A method can include determining whether a model solution that most accurately tracks the production history is unique, which can include varying an input parameter over a range of values and determining a plurality of model solutions. Production history data can include data representing a volume of oil, water, and/or gas produced by a well over a time period. A method can include iteratively adjusting an input parameter and computing a solution to a flow rate model until a solution is within an error criteria, and can include statistically comparing a solution from a first model with a solution from a second model, which can include determining a value based on one or more of the Akaike information criteria, the F-Value, the Baysian information criteria, and a combination thereof.

While the disclosed embodiments have been described with reference to one or more particular implementations, those skilled in the art will recognize that many changes may be made thereto without departing from the spirit and scope of the description. Accordingly, each of these embodiments and obvious variations thereof is contemplated as falling within the spirit and scope of the claimed invention, which is set forth in the following claims.

What is claimed is:

1. A computer implemented method, comprising:

selecting a first flow rate model for a well, the first flow rate model having at least one input parameter representing reservoir data and comprising at least formation matrix permeability value;

providing reservoir data to the first flow rate model;

providing production history data to the first flow rate model;

computing a solution to the first flow rate model using an initial value for the input parameter;

comparing the solution to the production history data;

adjusting the input parameter and computing the solution to the first flow rate model using the adjusted input parameter;

selecting a second flow rate model for a well, the second flow rate model having at least one input parameter representing reservoir data and comprising at least formation matrix permeability value;

providing reservoir data to the second flow rate model;

providing production history data to the second flow rate model;

computing a solution to the second flow rate model using the input parameter;

comparing the solution to the production history data;

adjusting the input parameter and computing the solution to the second flow rate model using the adjusted input parameter; and comparing the solution from the first model with the solution from the second model to determine an optimal model most accurately matching the production history data;

wherein the first flow rate model is a multi-porosity dimensionless flow rate model of the form:

$$\frac{1}{q(s)} = \frac{2\pi s}{\sqrt{sf(s)}}\mathrm{COTH}\left(-2\sqrt{sf(s)}\,y_{De}\right),$$

where q(s) represents a dimensionless flow rate in Laplace space, f(s) represents a fracture function, $y_{De}$ represents the dimensionless reservoir half-width and COTH is a hyperbolic cotangent function.

2. The method according to claim 1, wherein the input parameter represents reservoir data and comprises a value representing at least one of hydraulic fracture permeability and fracture length.

3. The method according to claim 1, further comprising determining whether the optimal model solution that most accurately matches the production history is unique.

4. The method according to claim 3, wherein determining whether the optimal model solution that most accurately matches the production history is unique further comprises varying the input parameter over a range of values and determining a plurality of optimal model solutions.

5. The method according to claim 1, wherein the production history data comprises data representing the volume of oil, water, and gas produced by the well over a time period.

6. The method according to claim 1, wherein adjusting the input parameter and computing the solution to the first flow rate model using the adjusted input parameter further comprises iteratively adjusting the input parameter and computing the solution to the first flow rate model until the solution is within an error criteria.

7. The method according to claim 1, wherein comparing the solution from the first model with the solution from the second model to determine an optimal model most accurately matching the production history data comprises statistically comparing the solution from the first model with the solution from the second model.

8. The method according to claim 7, further comprising wherein comparing the solution from the first model with the solution from the second model includes determining a value based on at least one of the Akaike information criteria, the F-Test value, and the Baysian information criteria and wherein the F-Test comprises a comparison between the first model having more parameters than the second model and the second model having less parameters than the first model to determine if the first model produces a lower error as compared to the second model.

9. A non-transitory computer readable medium having instructions stored thereon that, when executed by a processor, cause the processor to perform a method comprising:

selecting a first flow rate model for a well, the first flow rate model having at least one input parameter representing reservoir data and comprising at least formation matrix permeability value;

providing reservoir data to the first flow rate model;

providing production history data to the first flow rate model;

computing a solution to the first flow rate model using an initial value for the input parameter;

comparing the solution to the production history data;

adjusting the input parameter and computing the solution to the first flow rate model using the adjusted input parameter;

selecting a second flow rate model for a well, the second flow rate model having at least one input parameter representing reservoir data and comprising at least formation matrix permeability value;

providing reservoir data to the second flow rate model;

providing production history data to the second flow rate model;

computing a solution to the second flow rate model using the input parameter;

comparing the solution to the production history data;

adjusting the input parameter and computing the solution to the second flow rate model using the adjusted input parameter;

comparing the solution from the first model with the solution from the second model to determine an optimal model most accurately matching the production history data;

wherein the first flow rate model is a multi-porosity dimensionless flow rate model of the form:

$$\frac{1}{q(s)} = \frac{2\pi s}{\sqrt{sf(s)}}\mathrm{COTH}\left(-2\sqrt{sf(s)}\,y_{De}\right),$$

where q(s) represents a dimensionless flow rate in Laplace space, f(s) represents a fracture function, $y_{De}$ represents the dimensionless reservoir half-width and COTH is a hyperbolic cotangent function.

10. The computer readable medium according to claim 9, wherein the input parameter represents reservoir data and comprises a value representing at least one of hydraulic fracture permeability and fracture length.

11. The computer readable medium according to claim 9, further comprising determining whether the optimal model solution that most accurately matches the production hi story is unique.

12. The computer readable medium according to claim 11, wherein determining whether the optimal model solution that most accurately matches the production history is unique further comprises varying the input parameter over a range of values and determining a plurality of optimal model solutions.

13. The computer readable medium according to claim 9, wherein the production history data comprises data representing the volume of oil, water, and gas produced by the well over a time period.

14. The computer readable medium according to claim 9, wherein adjusting the input parameter and computing the solution to the first flow rate model using the adjusted input parameter further comprises iteratively adjusting the input parameter and computing the solution to the first flow rate model until the solution is within an error criteria.

15. The computer readable medium according to claim 9, wherein comparing the solution from the first model with the solution from the second model to determine an optimal model most accurately matches the production history data comprises statistically comparing the solution from the first model with the solution from the second model.

16. The computer readable medium according to claim 15, further comprising wherein comparing the solution from the first model with the solution from the second model includes determining a value based on at least one of the Akaike information criteria, the F-Test value and the Bayesian information criteria and wherein the F-Test comprises a comparison between the first model having more parameters than the second model and the second model having less parameters than the first model to determine if the first model produces a lower error as compared to the second model.

* * * * *